United States Patent [19]

MacFarlane

[11] Patent Number: 4,809,789

[45] Date of Patent: Mar. 7, 1989

[54] FINNED IMPACT OPERATING BORING TOOL

[75] Inventor: Ronald MacFarlane, Buffalo Grove, Ill.

[73] Assignee: Oklahoma Airrow, Inc., Perry, Okla.

[21] Appl. No.: 893,761

[22] Filed: Aug. 6, 1986

[51] Int. Cl.[4] ..... E21B 11/02

[52] U.S. Cl. ..... 173/91; 175/19

[58] Field of Search ..... 173/90, 91, 19

[56] References Cited

U.S. PATENT DOCUMENTS

| | | | |
|---|---|---|---|
| 2,498,192 | 2/1950 | Wright | 255/1.6 |
| 2,664,273 | 12/1953 | Merrick | 255/73 |
| 3,151,687 | 10/1964 | Sato et al. | 175/21 |
| 3,410,354 | 11/1968 | Sudnishnikov et al. | 173/125 |
| 3,651,874 | 3/1972 | Sudnishnikov et al. | 173/91 |
| 4,280,573 | 7/1981 | Sudnishnikov et al. | 175/418 |
| 4,570,723 | 2/1986 | Kostylev et al. | 173/90 |

FOREIGN PATENT DOCUMENTS

| | | | |
|---|---|---|---|
| 485200 | 1/1976 | U.S.S.R. | 175/19 |
| 658224 | 5/1979 | U.S.S.R. | 175/19 |
| 532268 | 5/1981 | U.S.S.R. . | |

*Primary Examiner*—Donald R. Schran
*Assistant Examiner*—Hien H. Phan
*Attorney, Agent, or Firm*—Foley & Lardner

[57] ABSTRACT

A finned impact-operated boring tool according to the invention has an elongated body with a frontally tapered nose which merged with a generally cylindrical housing. A circular array of fins project radially from the housing along the surface thereof rearwardly of the nose of the tool and near the juncture of the nose with the housing. Each fin is generally rectilinear, and the fins are spaced apart to define a series of grooves therebetween which extend in the lengthwise direction of the tool. The distance from the bottoms of these grooves to the lengthwise axis of the tool housing is greater than or equal to the distance from the tool axis to the outer surface of the housing. According to one embodiment of the invention, the fins are formed on a replaceable collar which fits over the node of the tool. The finned boring tool according to the invention has improved movement speed through the ground.

22 Claims, 1 Drawing Sheet

FINNED IMPACT OPERATING BORING TOOL

TECHNICAL FIELD

This invention relates to impact operated boring tools for driving holes in the earth by compaction. More particularly, this invention relates to an improved finned impact operated boring tool having an internal striker driven by an air valve connected to a supply of a pressure fluid. Such a tool is particularly adapted for boring horizontal holes beneath roadways.

BACKGROUND OF THE INVENTION

Impact operated ground piercing tools designed for horizontal earth boring are well known. Such tools typically comprise an elongated torpedo shaped housing which contains an air valve system and an air-driven striker. Sudnishnikov U.S. Pat. No. 3,410,354 issued Nov. 12, 1968 exemplifies such a tool. The pressure fluid, typically pressurized air, is fed through a hose to an air inlet pipe coaxially disposed at the center of the rear of the tool. This air inlet pipe is rigidly secured to the housing and is connected or integral at the forward end thereof with a stepped bushing which is an essential part of the valve mechanism.

The striker disposed within the housing of such tools is urged forwardly against a front wall or anvil surface, and the resulting impact drives the tool forwardly into the earth. The forwardly tapered nose of the tool pushes aside and compacts earth and other obstacles to form a hole. When the striker returns to a rearward position for another stroke, friction between the outer surface of the housing and the surrounding earth prevents the tool from traveling rearwardly out of the hole as far as it was driven into the hole during the forward stroke. By this means the tool gradually makes progress through the earth.

It is also known in the art to provide such a tool with a reversing mechanism. Essentially, this amounts to changing the relative position of the air valve mechanism so that the striker no longer impacts against the front wall or anvil surface, or impacts against such front surface only lightly, and instead impacts against a rear surface, thereby driving the tool backwards out of the hole. Sudnishnikov U.S. Pat. No. 3,651,874 issued Mar. 28, 1972 exemplifies such a reversing mechanism.

The present invention relates to a finned earth boring tool, particularly one having a housing when contains a striker and an air valve mechanism, which tool moves through the earth at a greater speed as compared to a similar, unfinned tool. Prior to the development of impact operated boring tools, a wide variety of finned or bladed earth boring tools were known. Corbosiero U.S. Pat. No. 2,354,245 issued July 25, 1944 and Merrick U.S. Pat. No. 2,664,273 issued Dec. 29, 1953 exemplify such known tools. Reamers having essentially rectangular grooves in the outer cylindrical surface thereof are also known, and have been employed in vertical drilling apparatus. See, for example, Wright U.S. Pat. No. 2,498,192 issued Feb. 21, 1950 and Sato U.S. Pat. No. 3,151,687 issued Oct. 6, 1964.

A variety of finned designs have been proposed for pneumatic impact operated boring tools. The foregoing patent to Zinkiewicz, Sudnishnikov U.S. Pat. No. 4,280,573 issued July 28, 1981 and Kostylev U.S. Pat. No. 4,570,723 are exemplary of U.S. patents disclosing such designs. It is also known to embody such fins or splines in a removable headpiece which fits over the nose of the tool. See the foregoing patent to Kostylev et al. Russian Pat. Nos. 532,286 issued Apr. 7, 1981 and 658,224 issued May 5, 1979 similarly disclose boring tools having tapered fins. The foregoing finned earth boring tools are of complex construction, and the fins of such devices are difficult to replace. The fins shown in the foregoing patents are quite large and would add substantially to the overall weight of the housing, which tends to reduce the power of the tool. In rocky soils, such large fins can cause the tool to jam and stop moving.

The foregoing patent to Kostylev et al. U.S. Pat. No. 4,570,723 contains specific teachings on the use of fins in self-propelled percussion machines for driving holes. According to that patent, several structural features are asserted to be important for providing a finned impact boring device which will drive a hole straight through the ground. In discussing the foregoing Russian Pat. No. 658,224, Kostylev et al. state that the use of a single tapered section including a finned conical sleeve will tend to cause the tool to deviate from a straight line when it encounters an obstacle. Kostylev et al. also teach that having a head end section of a diameter greater than the diameter of the rest of the housing is undesirable because such small length of the thickened part of the housing fails to assure directional stability.

As to the use of fins on the housing body, Kostylev et al. teach that the diameter of the cylindrical portion of the housing is greater than the diameter of a circle described about the bottoms of the recesses between projections and less than the diameter of a circle described about the tops of the projections. This allows the cross-sectional area of the cylindrical section of the housing to be approximately equal to the cross-sectional area of the housing at the location of the recesses and projections. This feature is supposed to afford greater machine reliability without reducing the rate of hole driving because the volume of soil deformed and the diameter of the hole are maintained. The tool according to the present invention has fins disposed in a manner contrary to the teachings of the foregoing patent to Kostylev et al. as described below.

SUMMARY OF THE INVENTION

The present invention provides an impact operated boring tool having a plurality of fins disposed on the outer surface thereof, which fins remarkably improve the performance of the tool, particularly the speed at which the tool moves through the ground. The impact operated boring tool according to the invention, which may be of the pressure fluid driven type as described above, comprises an elongated body having a frontally tapered nose which merges with a generally cylindrical housing. A generally circular array of fins project radially outwardly from the housing. This array of fins extends over a course along the surface of the housing rearwardly of the nose of the tool and is proximate the juncture of the nose with the cylindrical housing. Each fin has a generally rectilinear cross section throughout the major extent of its length. The fins are spaced apart to define a series of grooves which also extend in the lengthwise direction of the tool. The radial distance from the bottoms of these grooves to the central lengthwise axis of the housing of the tool is at least as great as, i.e. greater than or equal to, the radial distance from the central axis of the housing to the outer circular surface thereof rearwardly adjacent to the fins. According to a particularly preferred aspect of the present invention, the radial distance between the central longitudinal axis of the housing and the upper surfaces of the fins parallel therewith is greater than the distance between such as axis and any other part of the outer surface of the housing or nose.

The present invention further provides a collar mountable on an impact operated boring tool. Such a collar comprises a cylindrical, essentially tubular member having a circular formation of spaced apart fins which project radially outwardly from the surface thereof. Each of these fins has a generally rectilinear cross-sectional shape throughout the major extent of its length. The tubular member has an outer diameter preferably at least about ten times greater than the height of the fins, as will be described in detail below.

BRIEF DESCRIPTION OF THE DRAWING

Preferred exemplary embodiments of the present invention will hereafter be described in conjunction with the appended drawing, wherein like numerals denote like elements, and.

DETAILED DESCRIPTION OF PREFERRED EXEMPLARY EMBODIMENTS

Figures 1, 2, 3, 4, 5, 6:
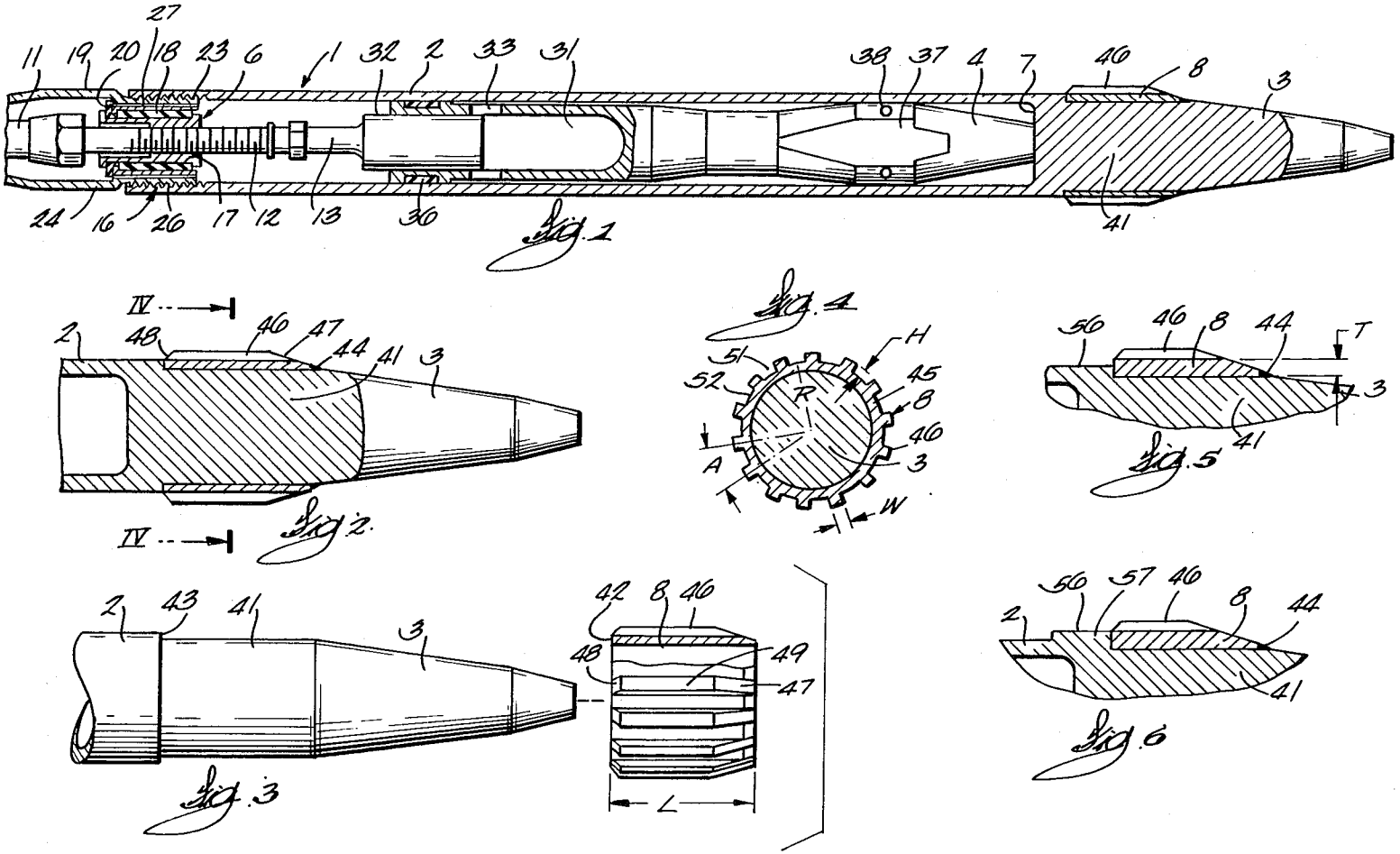
FIG. 1 is a longitudinal sectional view of a finned impact operated boring tool according to the invention.
FIG. 2 is a partial, enlarged view of a front end portion of the tool shown in FIG. 1.
FIG. 3 is an exploded view of the tool shown in FIG. 1, with the collar shown partly in section.
FIG. 4 is a cross-sectional view along the line IV—IV in FIG. 2.
FIG. 5 is a partial, sectional view of a front end portion of the tool according to an alternative embodiment of the invention.
FIG. 6 is a view similar to FIG. 5 of a further alternative embodiment according to the invention.

FIG. 1 illustrates an impact-operated boring tool according to the invention. The tool comprises an elongated, generally torpedoshaped body 1 having a generally cylindrical housing 2 and a frontally tapering nose 3. A striker 4 is disposed for reciprocal movement within housing 2. An air valve means 6 located rearwardly of striker 4 actuates striker 4 to engage an end wall 7 of housing 2 to transmit impacts to housing 2 to move the tool forwardly in the ground. A finned collar 8 is mounted at the front end of housing 2 adjacent nose 3. Pressurized fluid such as air is fed from a source such as hose 11 coupled to an inlet pipe 12 centrally disposed towards the rear of housing 2. A stepped bushing 13 is connected to the forward end of inlet pipe 12, or is integral therewith. A tailpiece assembly 16 supports air inlet pipe 12 so that pipe 12 is secured coaxially in housing 2.

Tail assembly 16 includes a sleeve 17, shock damper 18, tailpiece 19 and flapper valve 20. Sleeve 17 is coupled to the outside of inlet pipe 12, such as by means of threads, and has a pair of front and rear flanges 23, 24 for retaining shock damper 18 and flapper valve 20. Shock damper 18 surrounds sleeve 17 and adjoins front flange 23. Flapper valve 20 is retained between shock damper 18 and rear flange 24. A front, cylindrical portion 26 of tailpiece 19 is secured, preferably by threads, into the open rear end of housing 2. Shock damper 18 is held in close conforming contact between front portion 26 and sleeve 17 to dampen shocks transmitted from housing 2. Front portion 26 has a series of exhaust passages 27 extending therethrough. Flapper valve 20 is positioned to prevent clogging of exhaust passages 27 with foreign matter.

Air which enters the tool through air inlet pipe 12 and the interior of step bushing 13 flows into a rearwardly opening well 31 in striker 4. Well 31 is in close sealing contact with an enlarged front cylindrical portion 32 of stepped bushing 13. Well 31 has a radially opening port 33 therethrough. Port 33 is disposed just ahead of an enlarged rear portion 34 of striker 4 which is fitted with a resilient C-shaped split ring 36 which is compressed to fit within the interior of housing 2 but maintains a relatively light sliding fit therewith. An enlarged head 37 of striker 4 has a series of spot bearings 38 which maintain head 37 in aligned contact with the interior of housing 2. Ring 36 and spot bearings 38 may be made of self-lubricating plastic.

Striker 4, inlet pipe 12, stepped bushing 13 and tail assembly 16 together define air valve means 6 for causing striker 4 to reciprocate. Pressurized air entering well 31 from stepped bushing 13 moves striker 4 forwardly until striker 4 impacts against wall 7 and port 33 passes beyond the front end of stepped bushing 13, as shown in FIG. 1. Air then enters the space between housing 2 and striker head 37 and drives striker 4 rearwardly until port 33 passes beyond the rear of enlarged portion 32 of stepped bushing 13. Air then flows through port 33 rearwardly through the space between inlet pipe 12 and housing 2 and leaves the tool through the exhaust passages 27.

The relative position of stepped bushing 13 relative to striker 4 in the lengthwise direction may be changed by rotation of inlet pipe 12 relative to sleeve 17. If stepped bushing 13 is moved rearwardly by this means from the position shown in FIG. 1, striker 4 can impact against tail assembly 16 instead of end wall 7, which drives the tool rearwardly rather than forwardly through the ground.

As shown in FIGS. 1, 2 and 3, a solid, cylindrical front section 41 of housing 2, which adjoins forwardly tapering nose 3, has a slightly reduced diameter compared to housing 2 rearward thereof. Front section 41 comprises a stepped juncture between housing 2 and nose 3. Finned collar 8 fits over nose 3 into close contact with the outer surface of front section 41. A rear edge 42 of collar 8 abuts a step 43 at the rear end of front section 41. Finned collar 8 is then preferably secured in this position by a weld 44 made at the front of collar 8 towards the rear of nose 3. Weld 44 can be removed when it becomes necessary to replace collar 8.

The structure of collar 8 improves the performance of the tool, particularly the speed at which the tool moves through the ground. Collar 8 comprises a tube 45 having a series of fins 46. Fins 46 of collar 8 extend radially from the outer surface of tubular member 45 and are disposed in a generally circular formation. Fins 46 have a generally rectilinear sectional shape as viewed in the lengthwise direction (see FIGS. 1 and 2). However, front faces 47 of fins 46 preferably taper frontwardly at an angle of about 10 to 30 degrees over an approximate length of up to the front one-quarter of the collar. Similarly, rear faces 48 of fins 46 slope over a distance of about one-tenth the total length of collar 8 at an angle of from about 30 to 60 degrees, 45 degrees being typical. Sloped faces 47, 48 give fins 46 a trapezoidal shape in lengthwise section. Sloped faces 47, 48 enhance the burrowing ability of the tool by deflecting obstacles, and reduce the amount of metal needed to fabricate collar 8.

Over a major portion (at least about half) of length L of collar 8, fins 46 have upper surfaces 49 which parallel the axis of housing 2. Upper surfaces 49 ensure that the overall profile of collar 8 is essentially cylindrical, so that the tool will tend to burrow in a straight line.

The outer diameter of tubular member 45 is the same as or substantialy greater than the diameter of the remainder of housing 2, as contrasted with the collar of the Kostylev patent noted above, wherein the tube outer diameter is substantially less than the diameter of the housing. The present inventor has found that particularly remarkable improved tool speed through the ground results from employing fins 46 defining grooves 51 therebetween having rectilinear bottoms 52 which are essentially flush with the outer surface of housing 2 rearwardly thereof, and which extend parallel to the axis of housing 2. Bottoms 52 are preferably square or rectangular in cross-section. However, rounded (radiused) grooves may also be employed.

The dimensions of the tool, housing, collar and fins contribute to such improved results. The following table summarizes preferred approximate dimensions:

| Feature: | Preferred Sizes: | Most Preferred Sizes: |
|---|---|---|
| Housing 2 diameter | 2–17 inches | 2–6 inches |
| Total tool length | at least 20 inches | 20–75 inches |
| Length L of collar (and fins, see FIG. 3) | at least 2 inches, but not more than half total tool length | at least 2 inches, but not more than one-third total tool length |
| Fins 46: height H (to channel bottoms, FIG. 4) | $\frac{1}{8}$ to $\frac{5}{8}$ inch | $\frac{1}{8}$ to $\frac{1}{4}$ inch |
| Fins 46: Width W (FIG. 4) | $\frac{1}{8}$ to $\frac{5}{8}$ inch | $\frac{1}{8}$ to 5/16 inch |
| Angle A between fin centers (FIG. 4) | 15 to 90 degrees | 20 to 30 degrees |
| Thickness T of collar (FIG. 5) | $\frac{1}{8}$ to $\frac{1}{2}$ inch | $\frac{1}{8}$ to $\frac{1}{4}$ inch |
| Width of grooves between fins (FIG. 4) | at least $\frac{1}{8}$ inch | $\frac{1}{4}$ to $\frac{5}{8}$ inch |

The following table gives preferred relative dimensions according to the invention:

| Ratio | Preferred Ranges | Most Preferred Sizes: |
|---|---|---|
| Fin height H to collar thickness T | 1:2 to 2:1 | 1:2 to 1:1 |
| Total tool length to length of fins | 3:1 to 30:1 | 10:1 to 20:1 |
| Fin height H to diameter of tubular member 45 | 1:50 to 1:5 | 1:20 to 1:10 |

The total length of fins 46 relative to the overall length of the tool advantageously (preferably) are within the foregoing ranges to reduce (minimize) slowing the movement of the tool. The height of fins 46 is quite small relative to the diameter of housing 2. While such small fins might be expected to have little effect on tool performance, in fact use of such fins improves ground movement speed from two to five times as compared to an otherwise identical tool lacking such fins. If fins 46 are too high, they tend to break off more readily in use; if too short, the speed improvements dramatically decrease. The depth of grooves 51 need not be less than the height of the adjoining fins 46 in order to achieve such remarkable results.

The foregoing embodiment employs a finned collar 8 which can be replaced in the field. However, the fins could also be formed directly on the outside of housing 2 in the appropriate positions. Such integrally formed fins are not readily replaceable, but can readily be formed integrally with the housing body.

FIG. 5 illustrates an alternative embodiment according to the invention wherein the radial distance R (FIG. 4) from the axis of housing 2 to bottoms 52 of grooves 51 is greater by about 1/32 to $\frac{1}{8}$ inch than the radial distance form the axis of housing 2 to the outer surface 56 of housing 2 rearwardly adjacent fins 46.

FIG. 6 illustrates a further embodiment wherein housing 2 has an annular rim 57 rearwardly adjacent collar 8. The remainder of housing 2 rearwardly of rim 57 has an outer diameter intermediate the outer diameter of rim 57 and front section 41 of housing 2. Embodiments of FIGS. 5 and 6 provide additional compaction (i.e. bore a wider hole) at the front of the tool where fins 46 are disposed.

Operation of the impact operated pressure fluid driven embodiment of the invention has been described above. The fins according to the invention, which are relatively small in both height and length in preferred embodiments of the invention, nonetheless have a remarkable effect on the operating speed of the tool. This improved performance also occurs even though the cross-sectional area of the tool at the finned portion thereof is substantially greater than the cross-sectional area of the rest of the housing. The collar according to the present invention is relatively small and can be retrofitted onto tools to improve the performance thereof.

It will be understood that the above description is of preferred exemplary embodiments of the present invention, and the invention is not limited to the specific forms shown. Modifications may be made in the structural features of the invention without departing from the scope of the invention as expressed in the appended claims.

What is claimed is:

1. An impact operated boring tool, comprising:

an elongated body including a housing having a cylindrical outer surface and a frontwardly tapering nose adjoining said housing;

a series of radially divergent, longitudinally elongated fins disposed on said housing rearwardly adjacent said nose, said fins defining a series of parallel grooves therebetween having bottoms disposed at least as far in a radial direction from a longitudinal axis of said housing as said cylindrical outer surface of said housing is disposed from said axis, each of said fins having upper surfaces substantially parallel to said axis, which upper surfaces extend over a major part of the length of said fins, each of said fins further having a front face which tapers frontwardly toward said nose and a rear face which tapers rearwardly towards said outer surface of said housing, giving each fin a trapezoidal shape in lengthwise cross-section;

a striker movably disposed within said housing for impacting said housing; and air valve means connectable with a supply of pressurized air for reciprocating said strike within said housing.

2. The tool of claim 1, wherein said housing further comprises a front end section of smaller diameter than the extent of said housing rearwardly thereof, and a substantially cylindrical collar coaxially fitted onto said front end section of said housing, said collar having said fins disposed thereon.

3. The tool of claim 2, wherein said tool has at least eight of said fins, and said fins have radial heights in the range of $\frac{1}{8}$ to $\frac{5}{8}$ inches.

4. The tool of claim 2, wherein said collar has a substantially uniform inner diameter, and the thickness of said collar is substantially the same as the height of said fins projecting therefrom.

5. The tool of claim 2, wherein said grooves between said fins are rectilinear in cross-section and parallel to the lengthwise axis of said tool.

6. The tool of claim 1, wherein said rear faces of said fins taper at a greater angle than said front faces of said fins.

7. The tool of claim 6, wherein said front faces taper at an angle in the range of about 10 to 30 degrees, and said rear faces taper an an angle in the range of about 30 to 60 degrees.

8. The tool of claim 7, wherein said housing has a diameter in the range of about 2 to 6 inches, said tool has a length in the range of about 20 to 75 inches, said fins have lengths in the range of about 2 inches to one third the total length of said tool, said fins have heights in the range of about $\frac{1}{8}$ to $\frac{1}{4}$ inch, said fins have widths in the range of about $\frac{1}{8}$ to 5/16 inch, and a radial angle between centers of said fins is in the range of about 20 to 30 degrees.

9. In an impact-operated boring tool including an elongated body having a forwardly tapered nose merging to a generally cylindrical, elongated housing at a juncture therewith, said housing having a generally cylindrical outer surface; a generally circular array of fins projecting radially outwardly from the housing rearwardly to the juncture of said nose therewith; a striker movably disposed within said housing for impacting said housing; and air valve means connectable to a supply of pressurized air for reciprocating said striker within said housing, the improvement which comprises:

said fins are of generally rectilinear cross-section over a major extend of the length thereof and are spaced apart to define a series of parallel grooves therebetween, said grooves having bottoms disposed at least as far from a longitudinal axis of said housing as said outer, cylindrical surface of said housing is disposed from said axis.

10. The tool of claim 9, wherein said juncture comprises a stepped juncture having a reduced diameter over a course generally equal in length to the course of said fins, and said array of fins is formed on a collar having an inner diameter generally equal to the diameter of said juncture and an outer diameter generally equal to the diameter of said housing, said collar configured for a sliding fit over said nose and into engagement with said housing at said juncture.

11. The tool of claim 10, further comprising a weld securing the front end of said collar to said housing.

12. The tool of claim 10, wherein said housing has an annular rim formed thereon adjacent said stepped juncture.

13. The tool of claim 9, wherein said fins extend radially beyond the entirety of said cylindrical housing.

14. The tool of claim 9, wherein said radial distance between said longitudinal axis of said housing and said bottoms of said grooves is greater than the radial distance between said axis and said outer surface of said housing rearwardly adjacent said fins.

15. A collar mountable on an impact boring tool, which collar comprises a cylindrical tube having a generally circular array of spaced apart fins projecting radially outwardly from the outer surface thereof and defining a series of elongated, parallel grooves therebetween, each of said fins having a front face which tapers frontwardly and a rear face which tapers rearwardly, giving each fin a trapezoidal lengthwise cross-sectional shape, each of said fins having outer surfaces substantially parallel to a lengthwise axis of said collar, which outer surfaces extend over a major part of the length of said fins and span said front and rear faces of each of said fins.

16. The collar of claim 15, wherein said tube has an outer diameter at least about five times the radial diameter of said fins.

17. The collar of claim 15, wherein said tube has a thickness substantially equal to the height of said fins.

18. The collar of claim 15, wherein said collar has at least 8 of said fins, said fins being spaced part at regular intervals, each of said fins having a uniform height in the range of from $\frac{1}{8}$ to $\frac{5}{8}$ inch, said tube having a length of at least two inches and a thickness in the range of from $\frac{1}{8}$ to $\frac{1}{2}$ inch.

19. The collar of claim 15, wherein said rear faces of said fins taper at a greater angle than said front faces of said fins.

20. The collar of claim 19, wherein said front faces taper at an angle in the range of about 10 to 30 degrees, and said rear faces taper an an angle in the range of about 30 to 60 degrees.

21. The collar of claim 20, wherein said fins have lengths of at least about 2 inches, said fins have heights in the range of about $\frac{1}{8}$ to $\frac{1}{4}$ inch, said fins have widths in the range of about $\frac{1}{8}$ to 5/16 inch, a radial angle between centers of said fins is in the range of about 20 to 30 degrees, said tube has a diameter in the range of about 2 to 6 inches, and said tube has a thickness in the range of $\frac{1}{8}$ to $\frac{1}{2}$ inch.

22. The collar of claim 20, wherein a ratio of the height of said fins to the thickness of said tube is in the range of about 1:2 to 1:1, and a ratio of the height of said fins to the diameter of said tube is in the range of about 1:20 to 1:10.

* * * * *